US009546788B2

(12) United States Patent
Strong

(10) Patent No.: US 9,546,788 B2
(45) Date of Patent: Jan. 17, 2017

(54) COMBINED HIGH ENERGY IGNITER AND FLAME DETECTOR

(75) Inventor: Andrew H. Strong, Norwich, NY (US)

(73) Assignee: Chentronics, LLC, Norwich, NY (US)

( * ) Notice: Subject to any disclaimer, the term of this patent is extended or adjusted under 35 U.S.C. 154(b) by 792 days.

(21) Appl. No.: 13/491,250

(22) Filed: Jun. 7, 2012

(65) Prior Publication Data

US 2013/0330675 A1 Dec. 12, 2013

(51) Int. Cl.
*F23N 5/20* (2006.01)
*F23N 5/12* (2006.01)
*F23Q 3/00* (2006.01)

(52) U.S. Cl.
CPC ..... *F23N 5/123* (2013.01); *F23Q 3/008* (2013.01); *F23D 2207/00* (2013.01); *F23D 2208/10* (2013.01); *F23N 2027/22* (2013.01); *F23N 2027/36* (2013.01); *F23N 2029/02* (2013.01)

(58) Field of Classification Search
CPC ..... F23N 2029/02; F23N 5/12; F23N 5/123; F23N 2029/12; F23N 2027/36; F23N 2029/00; F23C 5/32
USPC ..... 431/71, 264, 46, 74, 14, 263, 68, 8
See application file for complete search history.

(56) References Cited

U.S. PATENT DOCUMENTS 2,684,115 A * 7/1954 Cairns, Jr. ..... 431/25
3,136,353 A 6/1964 Lloyd
3,245,457 A * 4/1966 Smith et al. ..... 431/6
3,343,366 A * 9/1967 Siegler et al. ..... 60/39.827
3,727,073 A * 4/1973 Cade ..... 307/117
4,325,690 A 4/1982 Hayes
4,391,582 A * 7/1983 Cowan ..... 431/266
4,402,663 A * 9/1983 Romanelli et al. ..... 431/66
4,404,616 A * 9/1983 Miyanaka et al. ..... 361/253
4,405,299 A * 9/1983 Serber ..... 431/78
4,413,303 A * 11/1983 Cheary et al. ..... 361/253
4,427,363 A * 1/1984 Hammond ..... 431/66
4,457,692 A * 7/1984 Erdman ..... 431/19
4,466,789 A 8/1984 Riehl
4,518,348 A * 5/1985 Wedge et al. ..... 431/265
4,527,125 A * 7/1985 Miyanaka et al. ..... 307/653
4,534,728 A * 8/1985 Vogels ..... 431/80
4,595,353 A * 6/1986 de Haan ..... 431/263
4,595,354 A * 6/1986 Guerra ..... 431/264
5,472,336 A * 12/1995 Adams et al. ..... 431/6
(Continued)

FOREIGN PATENT DOCUMENTS

DE 2336693 A1 2/1975
DE 20011457 U1 12/2000
(Continued)

OTHER PUBLICATIONS

Callidus Technologies by Honeywell, The Callidus Scepter Pilot and Scepter Model P1 Portable Igniter, Burner Pilot and Igniter System, 2011, Tulsa, Oklahoma.
(Continued)

*Primary Examiner* — Jason Lau

(57) ABSTRACT

An apparatus and method are provided for improved gas pilot burners, which are capable of simultaneous flame ignition and flame detection. More particularly, the invention provides for an apparatus and method capable of simultaneous high-energy ignition and flame ionization detection in a high-energy igniter that utilizes a spark rod located in a fuel channel.

19 Claims, 7 Drawing Sheets

(56) References Cited

U.S. PATENT DOCUMENTS

| | | | | |
|---|---|---|---|---|
| 5,577,905 | A * | 11/1996 | Momber et al. | 431/66 |
| 5,617,721 | A | 4/1997 | Slawson | |
| 5,655,900 | A * | 8/1997 | Cacciatore | 431/70 |
| 5,741,129 | A * | 4/1998 | Li | 431/264 |
| 5,777,216 | A * | 7/1998 | Van Duyne et al. | 73/114.67 |
| 5,779,465 | A | 7/1998 | Clarke et al. | |
| 5,865,616 | A * | 2/1999 | George | 431/284 |
| 6,059,562 | A * | 5/2000 | Anderson, II | 431/80 |
| 6,222,719 | B1 | 4/2001 | Kadah | |
| 6,509,838 | B1 * | 1/2003 | Payne et al. | 340/579 |
| 6,794,771 | B2 * | 9/2004 | Orloff | 307/117 |
| 7,241,135 | B2 | 7/2007 | Munsterhuis et al. | |
| 7,492,269 | B2 | 2/2009 | Matteson et al. | |
| 7,566,218 | B2 | 7/2009 | Aldrich | |
| 7,927,095 | B1 * | 4/2011 | Chorpening et al. | 431/66 |
| 8,066,508 | B2 | 11/2011 | Nordberg et al. | |
| 2002/0197575 | A1 * | 12/2002 | Neufield et al. | 431/42 |
| 2006/0257802 | A1 * | 11/2006 | Chian et al. | 431/18 |
| 2006/0257805 | A1 * | 11/2006 | Nordberg et al. | 431/28 |
| 2006/0286495 | A1 * | 12/2006 | Roussel | 431/24 |
| 2007/0224558 | A1 * | 9/2007 | Flick et al. | 431/75 |
| 2008/0096147 | A1 * | 4/2008 | Newsom | 431/12 |
| 2008/0141967 | A1 * | 6/2008 | Tani et al. | 123/143 B |
| 2009/0009344 | A1 * | 1/2009 | Chian | 340/577 |
| 2009/0181334 | A1 | 7/2009 | Moore | |
| 2010/0291494 | A1 * | 11/2010 | Branecky et al. | 431/78 |
| 2011/0086319 | A1 * | 4/2011 | Chodacki et al. | 431/74 |
| 2012/0288806 | A1 * | 11/2012 | Racaj | 431/18 |

FOREIGN PATENT DOCUMENTS

| | | |
|---|---|---|
| JP | S6071822 | 4/1985 |
| JP | S61180834 | 8/1986 |
| JP | H07117241 B | 11/1991 |
| JP | 2004-225932 | 8/2004 |

OTHER PUBLICATIONS

International Search Report and Written Opinion issued Oct. 18, 2013 in corresponding PCT/US13/44535, John Zink Company, LLC (assigned to Chentronics Corporation).

2875678, Canada Search Report dated Dec. 7, 2015.

11201408148R, Singapore Search Report dated Nov. 19, 2015.

JP-2015-516213, JP Search Report dated Jan. 26, 2016.

KIPO's Notice of Preliminary Rejection—issued on May 26, 2016 in corresponding Korea application No. 10-2015-7000119.

First Office Action—issued on Apr. 25, 2016 in corresponding China application No. 201380038295.5.

EP 13800648, European Search Report dated Nov. 27, 2015.

* cited by examiner

COMBINED HIGH ENERGY IGNITER AND FLAME DETECTOR

BACKGROUND

1. Field of the Invention

This invention pertains to ignition and sensing systems and more particularly to flame ignition and flame detecting or sensing systems. Even more particularly, the invention pertains to such systems having a spark type ignition.

2. Description of the Related Art

A gas pilot burner is a device used to create a stable pilot flame by combustion of a low flow rate (relative to the main burner) gaseous fuel-air mixture. The pilot flame is used to light a larger main burner, or a difficult to light fuel. Gas pilot designs normally include an ignition system and a flame detection system. The two most common types of ignition systems used in gas pilot burners are high tension (HT) and high-energy ignition (HEI). Flame detection is typically by a flame ionization detection (FID) system.

An HT flame ignition system typically utilizes a high voltage source and an HT spark plug or spark rod. The high voltage source provides high voltage, low current pulses. Often, such pulses will be 15 kV or greater and from about 10 to about 50 mA. HT systems create low amperage sparks that bridge an air gap created in a spark plug or between a spark rod and the grounded pilot frame. This spark is used to ignite the fuel-air mixture and, thus, generate the pilot flame. While this type of ignition can be low cost, it can be inconsistent when ignition conditions are not ideal. Moisture from steam or rain, contamination and heavy fuel can all generate ignition problems when using an HT system.

An HEI system typically utilizes a capacitive discharge exciter to pass large current pulses to a spark rod. The large current pulses are often greater than 1 kA. The spark rod or igniter probe for an HEI system is generally constructed using a center electrode surrounded by an insulator and an outer conducting shell over the insulator such that, at the ignition end of the spark rod, a high-energy spark can pass between the center electrode and outer conducting shell. HEI systems have the ability to maintain powerful high energy sparks in adverse conditions such as cold temperatures, heavy fuels (heavy gases or oils), contamination of the igniter plug with coking or other debris and moisture presence due to steam purging or rain.

For safety considerations, it is important that the ignition system ignites the fuel-air premix as soon as possible after the main fuel gas valve opens. It is also important that the flame ionization detection system registers the flame signal as soon as possible after the flame is established. Together, rapid ignition and flame detection help minimize the chance of explosion due to raw fuel being pumped into a burner. Typically, there is a burner management system (BMS) that controls the fuel and ignition systems while monitoring the flame ionization detection system. Often, the burner management system will give five seconds or less of fuel flow time before closing the fuel valve if flame is not proven. The window for ignition and detection is therefore very short.

Most prior HT ignition systems have used a combined HT and flame detection system wherein ignition must occur and then an electromechanical switch de-energizes the exciter and energizes the flame detector. This means ignition and detection are sequenced into two distinct time periods, each occupying a portion of the maximum limited allowable fuel valve open time window. HT or HEI systems allowing for simultaneous ignition and flame detection have relied on using completely separate ignition and detection systems. It would be beneficial to have a powerful ignition system, such as an HEI system, and a flame detection system that can operate simultaneously through the entire window where the flame detection system is an integral part of the HEI systems; that is, without utilizing completely separate ignition and detection systems.

SUMMARY

In accordance with one embodiment of the present invention, there is provided a pilot burner comprising a source of electrical energy, a spark rod and a housing. The spark rod has a first end, a second end and a flame rod connected thereto at the second end. The spark rod is connected to the source of electrical energy at the first end such that the electrical energy causes a spark at the second end. The housing has a fuel flow passage, which contains the second end of the spark rod. The position of the flame rod in the housing and the connection of the spark rod to the source of electrical energy is such that when no flame exists adjacent to the second end of the spark rod, no current flows between the flame rod and the housing and when a flame exists adjacent to the second end of the spark rod, current flows between the flame rod and the housing. The source of electrical energy and the pilot burner are capable of simultaneously generating the spark and providing the current.

In another embodiment of the invention, there is provided an apparatus for ignition and flame detection comprising a first electrode, a second electrode and a third electrode. The first electrode and second electrode each have a first end and a second end. The first electrode and the second electrode are positioned and electrically insulated from each other such that a spark tip is formed by the second ends so that, when the first ends are connected to a source of electrical energy, a spark can pass between the second end of the first electrode and the second end of the second electrode. When fuel is adjacent to the second end of the second electrode, the spark ignites the fuel and produces a flame. The second electrode is configured and positioned relative to the third electrode such that, when the flame is present between said second electrode and said third electrode, electricity is conducted between the second end of the second electrode and the third electrode but, when no flame is present, electricity is not conducted between the second electrode and the third electrode.

In a further embodiment, there is provided an ignition device comprising a source of rectified current, a flame detection circuit, a fuel source, a housing, an electrode, an insulating sleeve, an electrode tube and a controller. The source of rectified current has a high potential terminal and a low potential terminal. The housing has an electronics enclosure and a tube portion forming a longitudinal passage that is in fluid flow communication with the fuel source such that fuel from the fuel source flows through the longitudinal passage. The electronics enclosure and the longitudinal passage are sealed such that the fuel cannot pass between them. The housing is electrically grounded and the electronics enclosure contains the source of rectified current and flame detection circuit. The electrode has a first end and a second end. The first end is in the electronics enclosure and is connected to the high potential terminal. The electrode extends into the longitudinal passage. The insulating sleeve extends over at least a portion of the electrode. The electrode tube has a first end and a second end, wherein the first end is in the electronics enclosure and connected to the low potential terminal. The electrode tube extends into the longitudinal passage and is positioned around the insulating sleeve such that the electrode and the electrode tube are positioned so that a spark can pass between the second end of the electrode and the second end of the electrode tube to ignite the fuel and, thusly, produce a flame. The first end of the electrode tube is connected to the flame detection circuit. The flame detection circuit provides a current to the electrode tube. The second end of the electrode tube is configured such that, when the flame is established, current is conducted between the second end of the electrode tube and the housing but, when no flame is present, current is not conducted between the electrode tube and the housing. The controller is connected to the electrode tube, the fuel source and the source of electrified current. The controller detects the flow of current between the second end of the electrode tube and the housing and stops the flow of rectified current to the first terminal if current flow occurs.

In yet another embodiment, there is provided a process for simultaneous ignition and flame detection in a high energy igniter of the type that has a fuel channel having a grounded wall and a spark rod located therein with the spark rod being a type that has a center electrode and an electrode tube where the center electrode and electrode tube form a spark tip. The process comprises:

(a) providing a current to the electrode tube such that when a flame is present adjacent to the spark tip, a current will flow from the electrode tube to the grounded wall;
(b) providing a first potential to the center electrode;
(c) providing a second potential to the electrode tube wherein the first potential and second potential cause the spark tip to spark;
(d) introducing a fuel and air mixture into the channel such that the spark can ignite the fuel and air mixture;
(e) detecting whether the current flows from the electrode tube to the wall; and
(f) shutting down the first potential when the current is detected.

BRIEF DESCRIPTION OF THE DRAWINGS

FIG. 6 is a perspective view with partial cutaway of a pilot burner tip in accordance with yet another embodiment of the invention.

DETAILED DESCRIPTION

Figure 1:
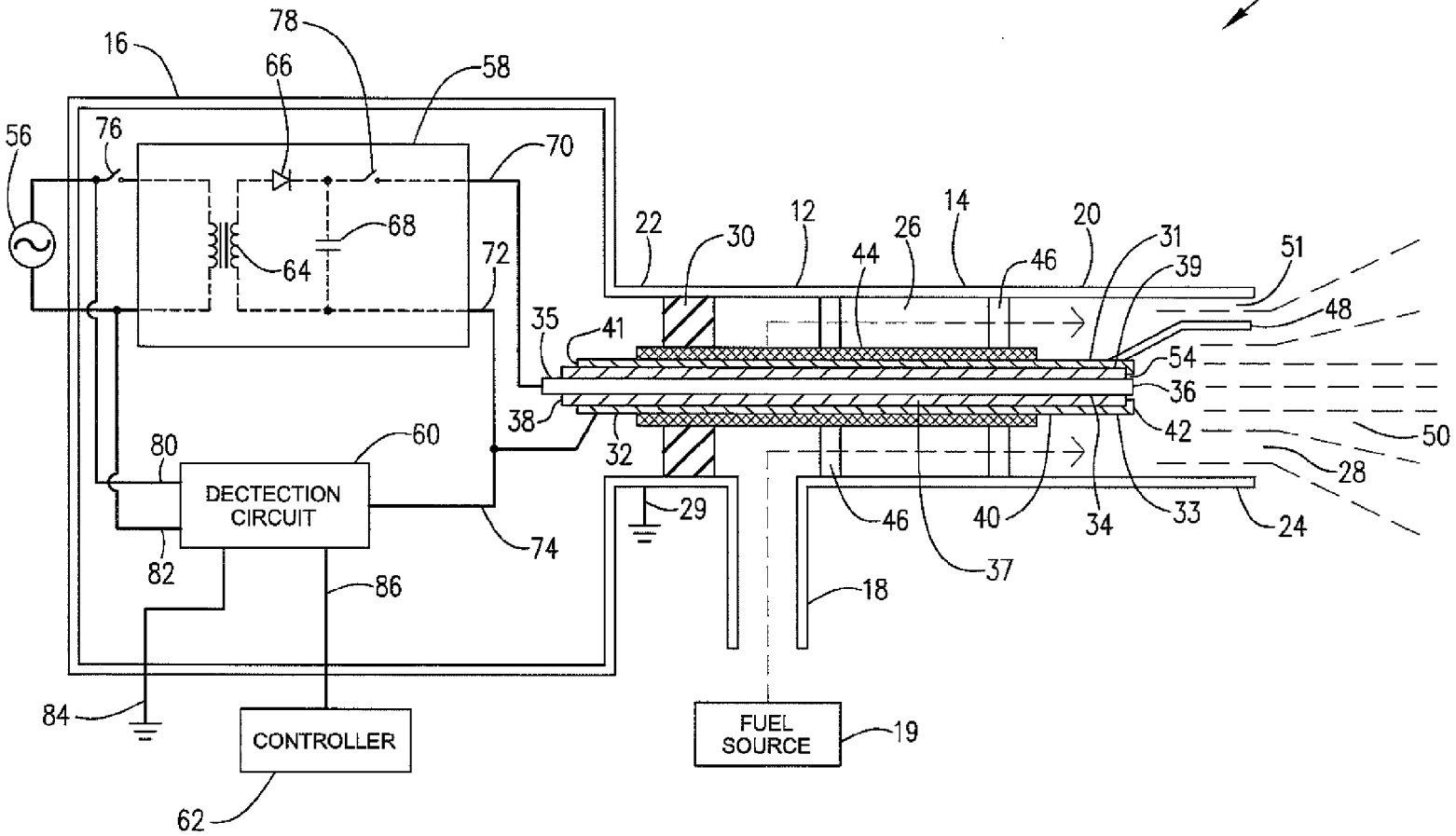
FIG. 1 is a schematic diagram of one embodiment of the current invention.

The description below and the figures illustrate a pilot burner or ignition system of the type used in a furnace having a main burner that supplies a fuel and air mixture to the furnace and a pilot burner adjacent to the main burner for igniting the fuel and air mixture. While the invention is described in the context of a pilot burner for such a furnace, it will be appreciated that the inventive ignition device is more broadly applicable as an ignition and flame detection system for fuels.

Referring now to FIGS. 1 through 4, an ignition device or pilot burner 10 in accordance with one embodiment of the invention is illustrated. Pilot burner 10 has a housing 12. Housing 12 is comprised of a main pipe or tube portion 14, electronics enclosure 16 and fuel introduction pipe 18. Tube portion 14 has a wall 20 having a first end 22 and a second end 24 and a longitudinal fuel flow passage or fuel channel 26 defined by wall 20. First end 22 is connected to electronics enclosure 16 and the wall 20 defines an opening 28 at second end 24. At or near first end 22 will be a sealing device 30 which seals fuel channel 26 so that it is not in fluid flow communication with electronics enclosure 16 and, hence, so that fuel cannot enter electronics enclosure 16.

Fuel introduction pipe 18 is in fluid flow communication with a fuel source 19 and longitudinal fuel flow passage 26 of tube portion 14. Generally, a fuel-air mixture will be introduced into passage 26 through pipe 18 such that the fuel-air mixture will flow in a generally longitudinal direction towards second end 24 and out opening 28.

Figure 2:
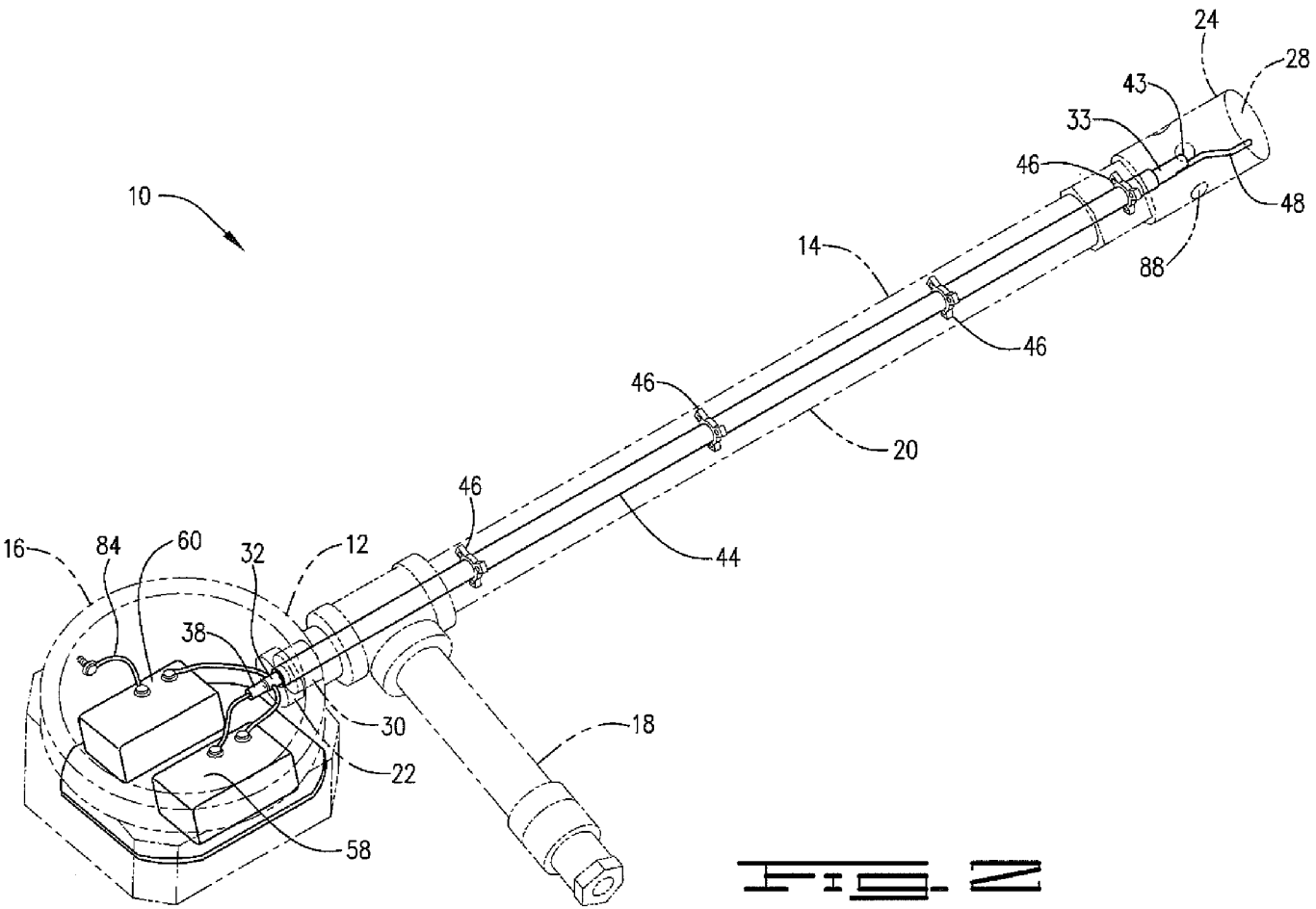
FIG. 2 is a perspective view of the apparatus of FIG. 1 with partial invisible walls.
Figure 3:
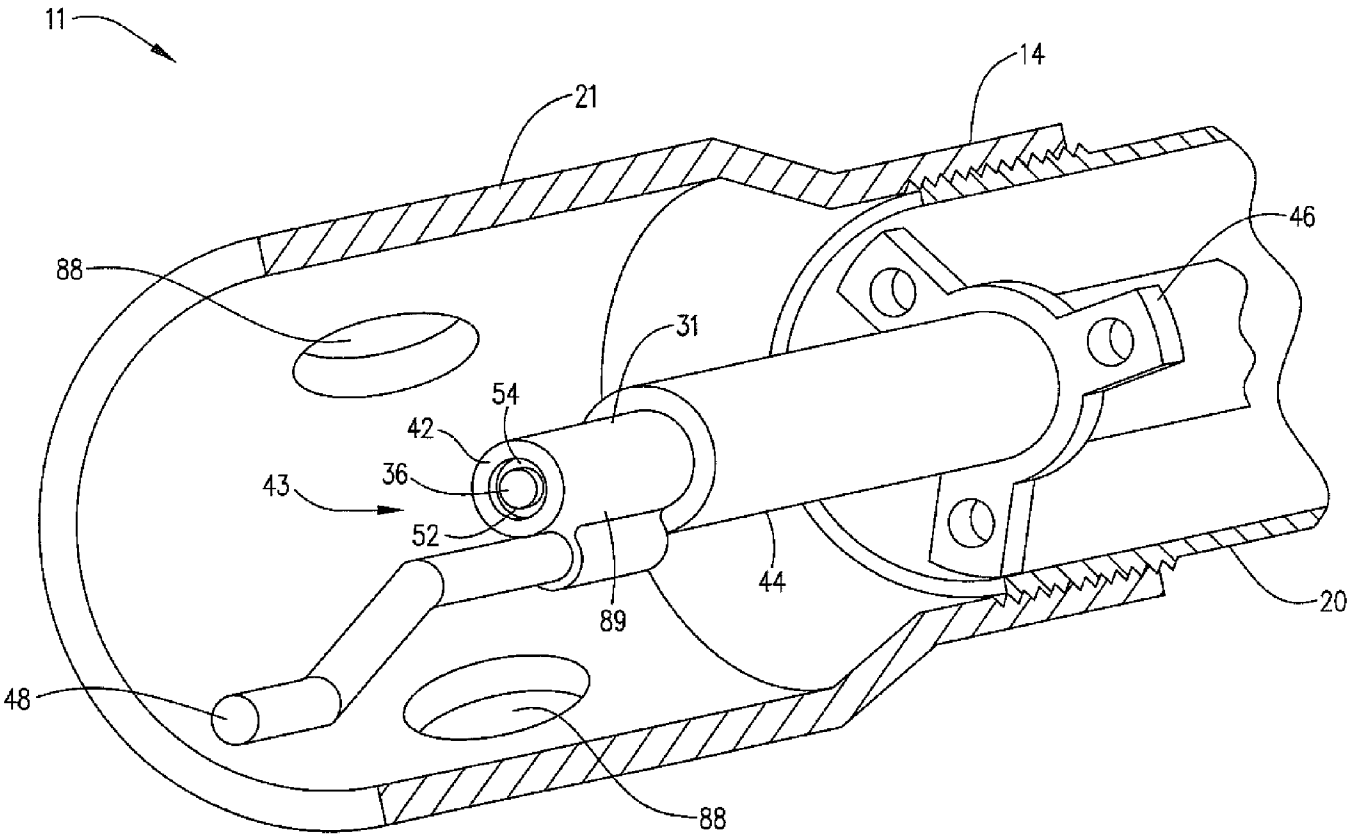
FIG. 3 is a perspective view with partial cutaway of a pilot burner tip in accordance with the embodiment illustrated in FIGS. 1 and 2.

Extending longitudinally along longitudinal passage 26 is a spark rod 31. Spark rod 31 has a first end 32 extending into electronics enclosure 16 and a second end 33 located near the second end of tube portion 14. Spark rod 31 is comprised of a center electrode 34, an insulating sleeve or tube 37 and an outer shell or electrode tube 40. Center electrode 34 has a first end 35 located within electronics enclosure 16 and a second end 36 located near, but spaced away from, second end 24 of tube portion 14 so that it is inside tube portion 14. Electrode tube 40 has a first end 41 located within electronics enclosure 16 and a second end 42 located near, but spaced away from, second end 24 of tube portion 14 so that it is inside tube portion 14. Insulating sleeve 37 has a first end 38 located within electronics enclosure 16 and a second end 39 located near second end 24 of tube portion 14 and, as shown, just short of the second ends of center electrode 34 and electrode tube 40 so as to form a well 54. Second ends of center electrode 34, insulating sleeve 37 and electrode tube 40 form spark tip 43 of spark rod 31 (as best seen in FIGS. 2 and 3). It should be understood that while spark rod 31 is illustrated as having a center electrode covered by a concentric insulating sleeve and a concentric electrode tube, it could have any other suitable design. Generally, spark rod 31 will have a first electrode and a second electrode that are electrically isolated from each other but with ends that are adapted to transmit a spark from one electrode to the other upon application of an electrical charge on the opposite ends of the electrodes.

As illustrated, spark rod 31 extends through a second insulating sleeve 44 that isolates spark rod 31 from housing 12, which is connected to ground wire 29 so that housing 12 is at ground potential. Generally, spark rod 31 is held in place by second insulating sleeve 44. While spark rod 31 can be attached to second insulating sleeve 44, it is preferred that they be slidingly engaged so that spark rod 31 can be removed from second insulating sleeve 44 at either first end 32 or second end 33. Second insulating sleeve 44 is held in place by sealing device 30 and structural supports 46, which are connected to second insulating sleeve 44. Optionally, structural supports 46 can be made from insulating material and connected directly to spark rod 31 without use of second insulating sleeve 44; however, this can hamper removal of spark rod 31 from first end 32 and/or second end 33.

Additionally, at second end 33 spark rod 31 has a flame rod 48 attached to electrode tube 40. Flame rod 48 is a conducting material that extends towards wall 20 of housing 12 but is not in contact with housing 12. Additionally, flame rod 48 is positioned such that when spark rod 31 has ignited the fuel-air mixture to produce a flame 50, flame rod 48 will be located within the flame.

As illustrated, spark rod 31 is a high-energy igniter (HEI) probe. Accordingly, spark rod 31 should be suitable to pass large current pulses (often greater than 1 kA) from an energy source, further described below, to the spark tip and, thereby, generate a spark at the spark tip. The purpose of an HEI probe is to provide high ignition power. In applications with low temperatures, heavy fuels (heavy gases or oils), contamination of the igniter plug with coking or other debris, or moisture presence due to steam purging or rain, the main fuel may be difficult to light but an HEI system has the ability to maintain powerful high energy sparks in these adverse conditions.

As described above, the HEI igniter probe is generally constructed using a center electrode 34, an insulation system (typically comprising insulation sleeve or tube 37) and outer shell or electrode tube 40. Outer electrode tube 40 is generally about 0.25 to 0.75 inches in diameter. In the past electrode tube 40 has been grounded and not isolated from the pilot frame or housing 12; however, it is an advantage of the current invention that electrode tube 40 not be grounded and be isolated from the housing and, hence, from ground, as is further described herein.

Additionally, a semiconductor material 52 (see FIG. 4) can be applied to the insulation tube at the end of the tip to form a conductive path between the center electrode 34 and the electrode tube 40. This semiconductor is normally a pellet type piece placed at the end of the insulation tip or a film applied to the insulator itself. This semiconductor assists the HEI probe with spark initiation by allowing a low level of current to pass in the semiconductor when the energy source applies an ignition pulse to the center electrode 34. This low level current flowing through the semiconductor creates a small ionized air zone above the path of current in the well 54 of spark rod 31. This small ionized air path is a low impedance pathway for current flow. Once the pathway is established, the electrical energy is able to flow unresisted except for circuit impedance, thereby creating a very high current and energy spark at well 54.

Turning now to electronics enclosure 16, it has at least partially located therein a source of electrical energy, which includes a power supply 56, exciter 58 and flame detection circuit 60. Power supply 56 (as shown located outside of electronics enclosure 16) provides electrical power to both exciter 58 and flame detection circuit 60. A controller 62, sometimes referred to as a burner management system (BMS), is operationally connected to the source of electrical energy.

Exciter 58 can be any high-energy exciter known in the art and suitable to provide a rapid electrical pulse to spark rod 31 and, thus, cause a spark at spark tip 43. Accordingly, exciter 58 will typically be a capacitive discharge device. In an exemplary exciter, exciter 58 has a transforming element 64, diode 66 and capacitor 68. Terminals 70 and 72 are in electrical connection with capacitor 68. Additionally, terminal 70 is connected to center electrode 34 at first end 35 and terminal 72 is connected to electrode tube 40 at first end 41. Terminal 72 is also connected to terminal 74 of flame detection circuit 60.

Electrical input to exciter 58 can by controlled by switch 76, which is operationally connected to controller 62 (connections not shown). Accordingly, when controller 62 activates switch 76, transforming element 64 steps up the incoming voltage and diode 66 rectifies it such that capacitor 68 is charged by the step up transformer. When a predetermined threshold voltage is reached, switch 78 is closed by the exciter's controller (not shown). This causes the spark gap, between center electrode 34 and electrode tube 40 at spark tip 43, to connect to the potential deference stored on the capacitor 68 and create an arc. Thus, energy in capacitor 68 flows through terminal 70 (in this case the high potential terminal) through center electrode 34, across well 54 (spark gap), through electrode tube 40 and terminal 72 (in this case the low potential terminal) and back to the capacitor 68. This large capacitive current results in a powerful spark across well 54.

Accordingly, for the illustrated exciter, it can be said that terminal 70 has a high potential and terminal 72 has a low potential with low potential terminal 72 having an electrical potential below the potential of high potential terminal 70 but above ground potential. This is achieved through galvanic isolation in the transforming element 64 and by electrical connection to terminal 74 of flame detection circuit 60.

While the embodiment illustrated in FIGS. 1 and 2 utilizes an exciter than generates a rectified current, it should be understood that the invention is not limited to such an exciter. For example, alternatively, the exciter cannot utilize diode 66 so that the exciter comprises a ringing tank circuit. In such an embodiment, the exciter emits a high amperage alternating pulse and terminals 70 and 72 would alternate between being the high potential terminal and the low potential terminal; however, each would be above ground potential. Other forms of exciters useful in the present invention will be apparent to those skilled in the art based on the disclosure herein.

Figure 7:
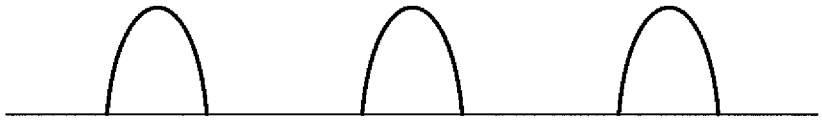
FIG. 7 is a graphical representation of a rectified current similar to the rectified current across the flame rod-wall gap that occurs when a flame is present.

As previously mentioned, flame detection circuit 60 is supplied power by power supply 56 through terminals 80 and 82. Flame detection circuit 60 is connected to ground wire 84 and is connected to low potential terminal 72 and electrode tube 40 through terminal 74. As mentioned above, terminal 70, electrode 34, terminal 72 and electrode tube 40 are all isolated from ground. Tube portion 14, however, is grounded. Accordingly, when flame detection circuit 60 is activated, there is potential across the gap 51 between flame rod 48 and tube portion 14. As explained below, only when a flame is present and extends between flame rod 48 and tube portion 14, will there be a conductive pathway between flame rod 48 and tube portion 14. However this pathway only conducts current from flame rod 48 to tube portion 14; hence, if the current applied is an alternating current, only a rectified current is passed, similar to that illustrated in FIG. 7.

Flame detection circuit 60 provides a signal 86 to controller 62. Controller 62 is operationally connected to switch 76, flame detection circuit 60 and the fuel source 19 such that, based upon signals 86 received from flame detection circuit 60, controller 62 can start or stop either the exciter 58 or the fuel-air mixture flowing into pipe 18 or both, as further explained below.

Figure 4:
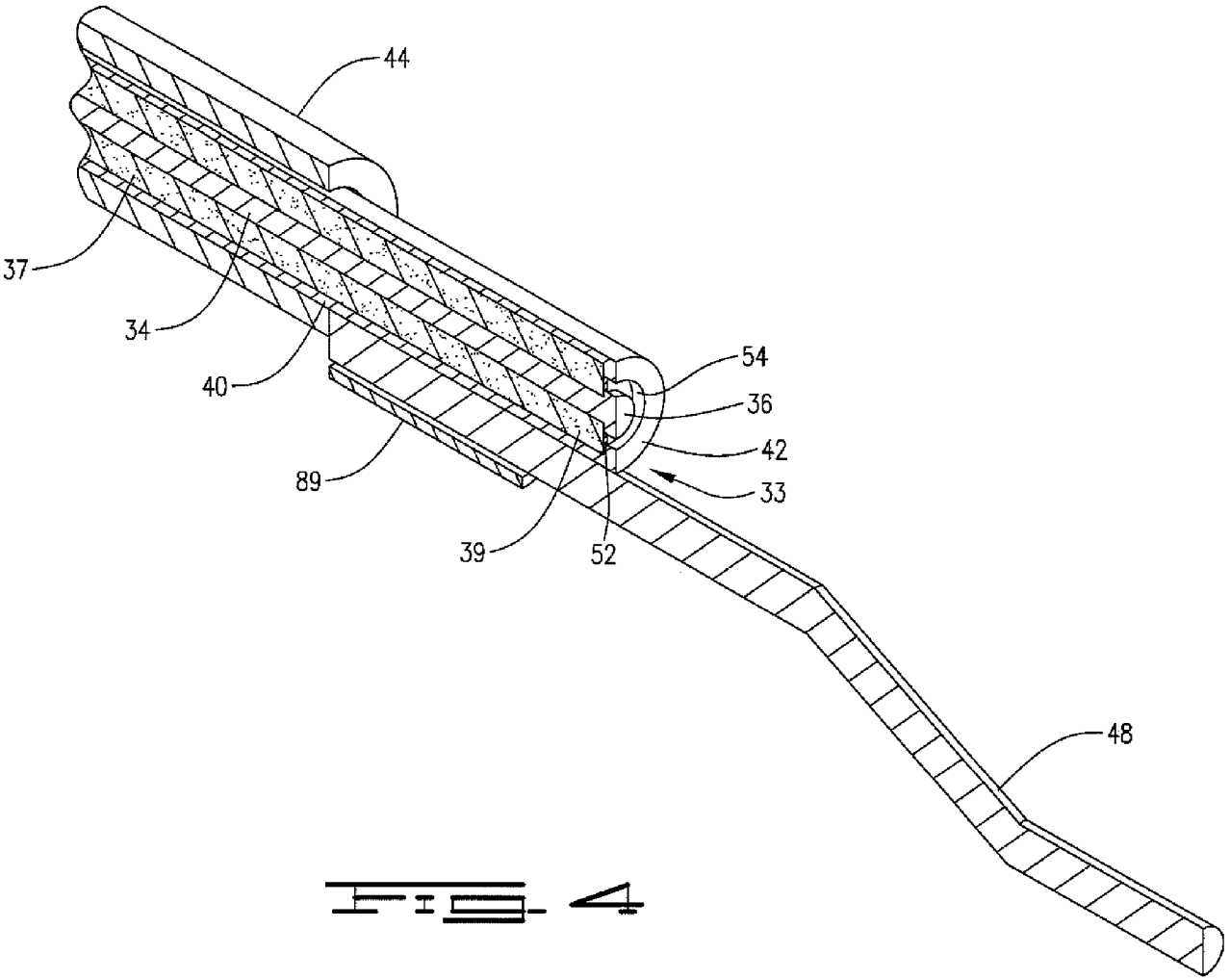
FIG. 4 is a perspective view with partial cutaway of a spark rod tip and flame rod in accordance with FIGS. 1 and 2.

The tip of pilot burner 10 can be better seen with reference to FIGS. 3 and 4. At pilot burner tip 11, tube portion 14 comprises wall 20 and hood 21. Hood 21 can have air holes 88 located near the second end 33 of spark rod 31 to provide additional air to the flame once the fuel has been ignited. Spark rod 31 is seated inside second insulating sleeve 44.

The insulating sleeve 44 is held in position concentrically or off center to tube portion 14 by sealing device 30 and structural support 46. Second end 36 of center electrode 34 and second end 42 of electrode tube 40 extend slightly beyond second end 39 of insulating sleeve 37 so as to form well 54; thus, the second ends form spark tip 43. Additionally, a semiconductor 52 can be deposited on the second end of insulating sleeve 37 to aid in spark conception. Flame rod 48 is welded or otherwise conductively affixed to the exposed end 89 of electrode tube 40. The flame rod 48 is bent in an elongated Z configuration in order to place it near hood 21 of wall 20 but not in contact with and a suitable distance from wall 20 so that there is no electrical conduction between flame rod 48 and wall 20 unless a flame is present. Although illustrated in an elongated Z configuration, other configurations, such as a scythe or curved shape configuration may be used. The flame rod can be constructed of any suitable conductive material so long as it is isolated from housing 12 and is positioned to be in the flame, after ignition has occurred, such that rectified current flow can occur, as further explained below.

Figure 5:
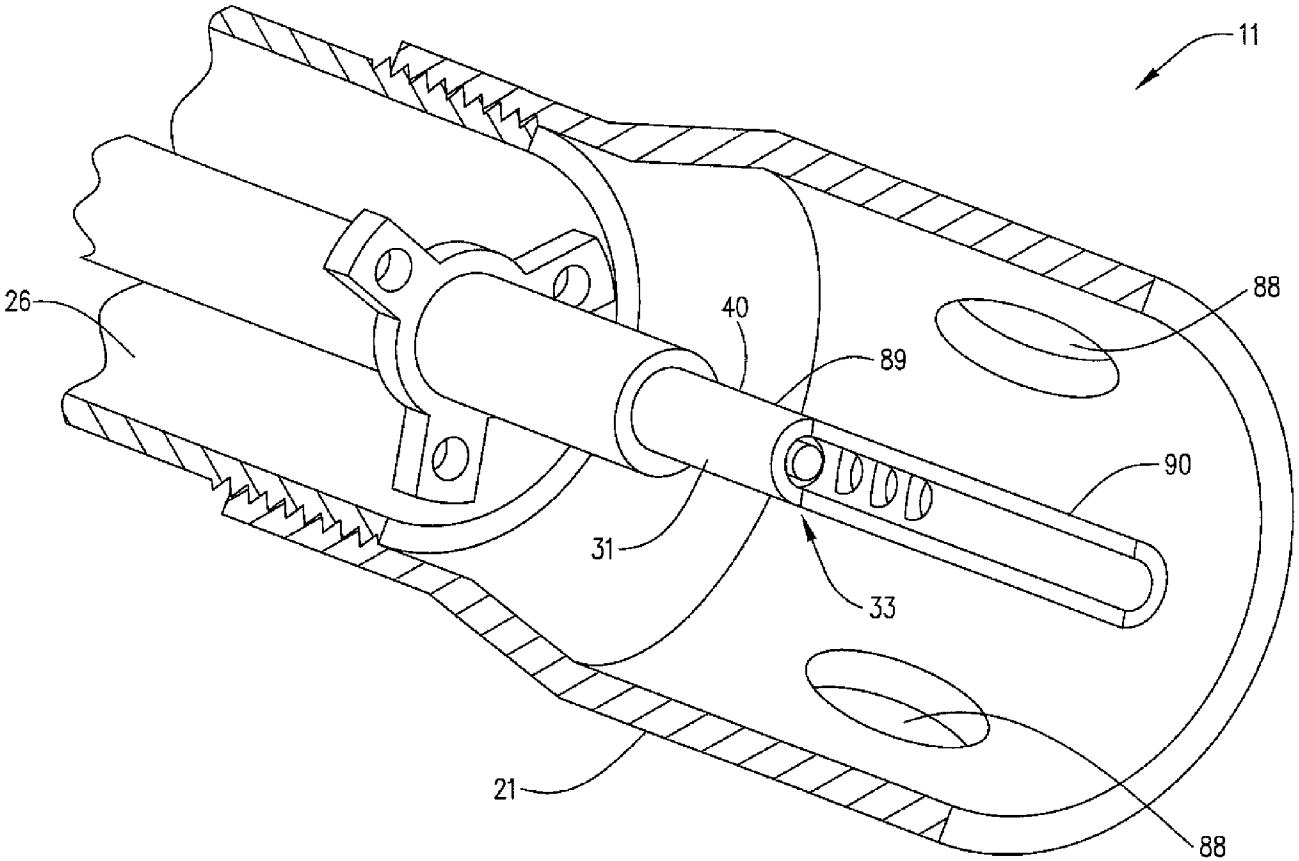
FIG. 5 is a perspective view with partial cutaway of a pilot burner tip in accordance with another embodiment of the invention.
Figure 5:
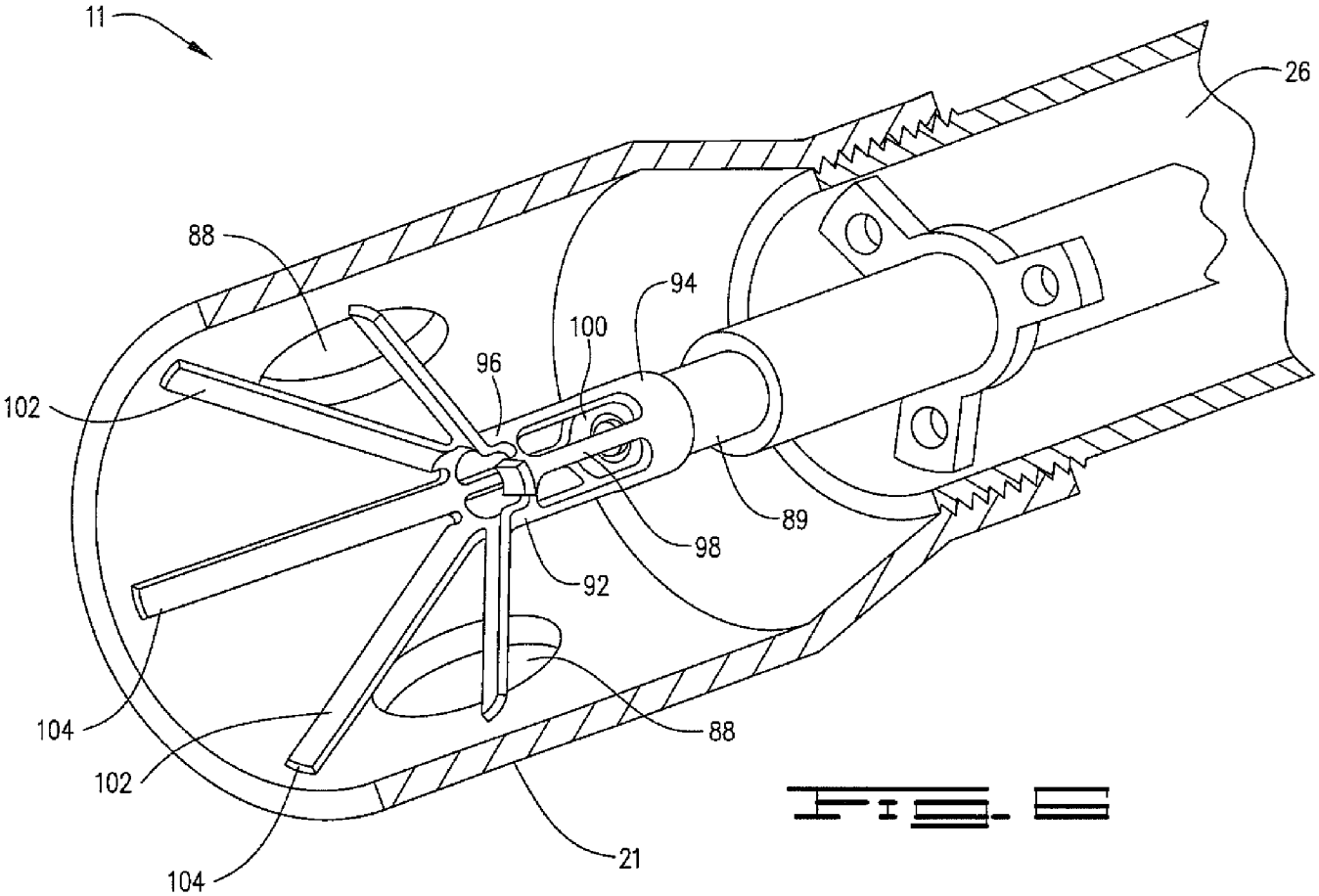

FIGS. 5 and 6 illustrate other embodiments using different flame rod configurations. In FIGS. 5 and 6 like components to those in FIGS. 1-4 have received like designations. Referring now to FIG. 5, flame rod 90 is formed by a portion of electrode tube 40, which extends out from the exposed end 89 of electrode tube 40 and from second end 33 of spark rod 31. Flame rod 90 has a cross section that is a partial circle, generally a half circle or C-shaped cross section, such that at least a portion of the second end 33 is exposed to the fuel-air mixture passing through longitudinal passage 26 so that the spark occurring at second end 33 can ignite the fuel-air mixture. Flame rod 90 is designed to fit within the outer diameter of electrode tube 40 and, hence, within the inner diameter of second insulating sleeve 44. In other words, flame rod 90 does not extend radially outward from the electrode tube farther than the outer radius of the electrode tube. Accordingly, flame rod 90 allows spark rod 31 to slide through second insulating sleeve 44 so that it can be replaced from the first end 22 of tube portion 14; thus, improving the ease of replacement of spark rod 31. Because flame rod 90 extends longitudinally downstream from spark rod 31 and not radially outward, it can be advantageous for the spark rod to be located off-center of the tube portion 14 so that flame rod 90 is near to wall 20 and better able to establish electrical flow when flame is established.

Referring now to FIG. 6, flame rod 92 has a first ring portion 94 that slides over and makes conductive contact with the exposed end 89 of electrode tube 40. Flame rod 92 has a second ring portion 96 and struts 98 extending between first ring portion 94 and second ring portion 96 to create apertures 100. Apertures 100 expose the second end 33 of spark rod 31 to the fuel-air mixture passing through longitudinal passage 26 such that the spark occurring at second end 33 can ignite the fuel-air mixture. Extending from second ring portion 96 are flame rod fingers 102. Fingers 102 can extend radially outwardly from second ring portion 96 or at an angle so that they extend radially and longitudinally outwardly from second ring portion 96. The tips 104 of fingers 102 should be located near but isolated from wall 20 so that they are not in contact with hood 21 of wall 20 and are a suitable distance so that there is no electrical conduction between flame rod 92 and wall 20, unless a flame is present. The tips 104 should be positioned to be in the flame, after ignition has occurred, such that rectified current flow can occur, as further explained below. First ring portion 94 can be fixedly attached to the exposed end 89 of electrode tube 40 or can be slidingly engaged onto the exposed end 89. If slidingly engaged onto the exposed end 89 then flame rod 92 can be removed to allow spark rod 31 to slide through second insulating sleeve 44 so that it can be replaced from the first end 22 of tube portion 14; thus improving the ease of replacement of spark rod 31.

In operation, fuel and air are introduced into longitudinal passage 26. The fuel and air may be introduced from a fuel-air mixture source 19 into fuel introduction pipe 18 or may each be introduced from separate sources into fuel introduction pipe 18. Fuel introduction pipe 18 is in fluid flow communication with longitudinal passage 26 and the fuel and air in pipe 18 is under positive pressure so that fuel and air within pipe 18 flows into longitudinal passage 26. Within longitudinal passage 26, the fuel and air flows in a generally longitudinal direction through passage 26 around spark rod 31 and around and through structural supports 46. Structural supports 46 can be perforated and can be shaped into swirling or diffusion elements to induce premixing of fuel and air within longitudinal passage 26 and prior to reaching the second end 33 of spark rod 31. Whether mixed within longitudinal passage 26 or mixed prior to introduction to fuel introduction pipe 18, the air and fuel should be adequately mixed upon reaching the second end 33 of spark rod 31 to produce a flame upon exposure to a spark from spark tip 43.

Prior to spark initiation, flame detection circuit 60 is powered up. Terminal 74 of flame detection circuit 60 is connected to potential terminal 72 of exciter 58 and electrode tube 40, thus supplying a small current potential to both. While this current can be direct current or alternating current, the operation will be described with respect to alternating current, except where indicated. Spark is initiated by closing switch 76; thus providing power to exciter 58. Center electrode 34 is connected to terminal 70 of exciter 58 and, as previously indicated, electrode tube 40 is connected to the terminal 72 of exciter 58 and flame detection circuit 60. Accordingly, in the embodiment of FIG. 1, since terminal 70, terminal 72, center electrode 34 and electrode tube 40 are isolated from ground, they are maintained at a higher potential than ground; however, when switch 78 is closed, there is a high potential difference between terminal 70 and terminal 72. This high potential difference is what creates the spark at spark tip 43.

When the exciter 58 provides a sufficiently large potential difference, an electrical pulse will jump between electrode 34 to electrode tube 40 at the spark tip 43 of spark rod 31; preferably, the current will follow the ionized path created by the semiconductor 52. This electrical pulse will be in the form of a spark and can ignite the fuel-air mixture around second end 33 of spark rod 31.

A flame produces free ions in the vicinity of the flame envelope that form an electrically conductive pathway. By placing two electrodes in the flame and applying a voltage between them, a small current will result (less than 10 μA). If one of the electrodes is much larger than the other, current will flow more easily from the small electrode to the large electrode than vice-versa. By applying an AC voltage between the electrodes, a current rectifying property will result and a current will flow across the gap between the two electrodes similar to the rectified current illustrated in FIG. 7. Detection of this rectification can be used to prove the presence of a flame.

In the invention, tube portion 14 is electrically grounded and serves as a third electrode. Flame rod 48 is designed to be much smaller than tube portion 14 and, when no flame is present, is electrically isolated from tube portion 14 of the housing 12, and hence from ground. Accordingly, if no flame is present, then no current will flow from flame rod 48 to tube portion 14. If the spark generated at second end 33 of spark rod 31 creates a flame, flame rod 48 is positioned to be in the flame. In other words, the flame rod 48 is positioned so that the flame 50 will bridge the gap 51 so that spark rod 31 is no longer electrically isolated from tube portion 14 and a rectified current (similar to that illustrated in FIG. 7) is established that flows from flame rod 48 to tube portion 14.

Figure 8:
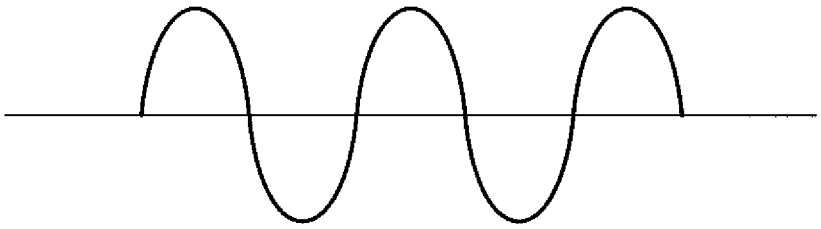
FIG. 8 is a graphical representation of an alternating current such as detected by the flame detection circuit when there is a short or fault in an HEI/FID system in accordance with the present invention.

Detection circuit 60 sends a signal to controller 62 based on the establishment of a current between flame rod 48 and tube portion 14. When a rectified current is established, detection circuit 60 sends a signal to controller 62. In response to the signal, controller 62 opens switch 76 to shutdown exciter 58 and, hence, stop spark rod 31 from generating sparks. If controller 62 does not receive the signal that a rectified current is established within a predetermined period of time (the timeout period), then controller 62 will shutdown exciter 58 and stop fuel introduction into pipe 18. Additionally, in the case of a short or ground failure, an alternating current can be established between flame rod 48 and tube portion 14, similar to the current illustrated in FIG. 8. If detection circuit 60 detects an alternating current flow between flame rod 48 and tube portion 14, it sends a signal to controller 62 and controller 62 will shutdown exciter 58 and stop fuel introduction into pipe 18. While a direct current can be used for flame detection, it will not allow the detecting of a short or ground failure in the manner of an alternating current.

In one embodiment, an inventive integrated high energy ignition (HEI) and flame ionization detection (FID) device operates as follows:

(a) The integrated HEI/FID device is powered up, which turns on the flame detection circuit 60.

(b) The controller 62 begins polling the flame signal 86 from the flame detection circuit for proof of flame. If signal 86 indicates that an alternating current is flowing, then controller 62 aborts steps (c) to (f).

(c) The controller powers the HEI exciter 58 by closing switch 76. The HEI exciter begins sparking the spark rod 31.

(d) The controller opens the main fuel valve and continues to monitor the flame signal 86.

(e) The controller shuts off the flow of fuel to pipe 18 if flame is not detected before the timeout period is up. The sequence can repeat from step (b) for a predetermined number of attempts. Repetition can be subject to a predetermined wait period between attempts.

(f) If flame is proven within the time out period, the controller shuts down the HEI exciter 58 and continues to monitor the flame signal.

For safety considerations, it is important that the ignition system ignite the fuel-air mixture as soon as possible after introduction of fuel into pipe 18 has commenced. Accordingly, the timeout period is typically set very short, often five (5) seconds or less. Accordingly, it is important that the flame detection system registers positive flame signal as soon as possible after flame is established. As will be realized from the above description, the current invention has the advantage of being capable of simultaneous rapid ignition and flame detection utilizing an integrated ignition and flame detection system. The term simultaneous refers generally to flame detection during the period that the exciter is energized and the spark rod is sparking. In a system with sequential flame detection, the ignition attempt (sparking of the spark rod) is made, then the exciter is de-energized, and then the flame detector is energized to detect flame. If no flame is detected, the flame detector is de-energized and the exciter re-energized to initiate another spark. In a system with simultaneous flame detection, there is no de-energizing of the exciter for the spark rod before flame detection.

Together, this simultaneous rapid ignition and flame detection help minimize the chance of explosion due to raw fuel being pumped into a burner. Prior art systems have not been able to achieve simultaneous ignition and flame detection in an integrated system. They instead relied on either sequenced ignition and flame detection or completely separate ignition and detection systems.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A process for simultaneous ignition and flame detection in a high energy igniter of the type that has a fuel channel having a grounded wall and a spark rod located therein and said spark rod being a type that has a center electrode and an electrode tube wherein said center electrode and outer electrode tube form a spark tip, said process comprising:

(a) providing an electrical potential to said electrode tube such that when a flame is present adjacent to said spark tip, a current will flow from said electrode tube to said grounded wall;

(b) providing a first potential to said center electrode;

(c) providing a second potential to said electrode tube wherein said first potential and second potential cause said spark tip to spark;

(d) introducing a fuel and air mixture into said channel such that said spark can ignite said fuel and air mixture; and (e) detecting whether said current flows from said electrode tube to said wall during steps (c) and (d).

2. The process of claim 1 further comprising:

(f) shutting down said first potential when said current is detected; and (g) shutting down said flow of said fuel and air mixture if said current is not detected in a predetermined time.

3. The process of claim 2 further comprising repeating steps (b) through (g) after a predetermined timeout period.

4. The process of claim 1 wherein said electrical potential provided in step (a) is an alternating electrical current and said detecting step (e) further comprises determining whether said current is a rectified current or an alternating current.

5. The process of claim 4 further comprising shutting down said first potential and said flow of said fuel and air mixture if said current is determined to be flowing in two alternating directions.

6. The process of claim 1 further comprising:

detecting whether said current flows from said outer electrode tube to said wall prior to step (b) of providing said first potential to said center electrode; and thereafter, aborting said steps (b) through (f) if said current flow is detected.

7. A process for simultaneous ignition and flame detection in a high energy igniter of the type that has a fuel channel having a grounded wall and a spark rod located therein and said spark rod being a type that has a center electrode and an electrode tube wherein said center electrode and outer electrode tube form a spark tip, said process comprising:

(a) providing an alternating electrical potential to said electrode tube such that when a flame is present adjacent to said spark tip, a current will flow from said electrode tube to said grounded wall;

(b) detecting whether said current is flowing from said electrode tube to said grounded wall prior to step (d);

(c) aborting steps (b) through (j) if said current is detected;

(d) providing a first potential to said center electrode;

(e) providing a second potential to said electrode tube wherein said first potential and second potential cause said spark tip to spark;

(f) introducing a fuel and air mixture into said channel such that said spark can ignite said fuel and air mixture;

(g) detecting whether said current flows between said electrode tube and whether said current is a rectified current or an alternating current during steps (e) and (f);

(h) shutting down said first potential when a rectified current is detected;

(i) shutting down said first potential and said flow of said fuel and air mixture when an alternating current is detected;

shutting down said flow of said fuel and air mixture if said current is not detected in a predetermined time; and (k) repeating steps (d) through (j) after a predetermined timeout period.

8. A process for simultaneous high energy ignition and flame detection in a high energy igniter, said process comprising:

(a) providing a first electrical potential to a first electrode having a spark end, wherein said first electrode is positioned and electrically insulated from a second electrode having a spark end such that a spark gap is formed by said spark end of said first electrode and said spark end of said second electrode; wherein said second electrode is at a lower electrical potential than said first electrode so that a spark arcs across the spark gap and, when fuel is adjacent said spark gap, said spark ignites said fuel and produces a flame; wherein the electrical potential of the second electrode and the first electrical potential of the first electrode cause the spark across the spark gap;

(b) providing an alternating electrical potential between the second electrode and a third electrode wherein said second electrode and third electrode form a flame detection circuit such that when flame is present between said second electrode and said third electrode, a current will flow between said second electrode and said third electrode; and (c) detecting whether a current flows between said second electrode and said third electrode such that, when said fuel is being ignited by said spark, there is simultaneous detection of said flame during the period of time that said fuel is ignited.

9. The process of claim 8, wherein said simultaneous detection of said flame and igniting of fuel is by a single integrated circuit.

10. The process of claim 8, wherein there is detection of said flame after flame ignition for as long as said flame is present.

11. The process of claim 8, wherein there is a semiconductor at said spark gap to form a conductive pathway between said spark end of said first electrode and said spark end of said second electrode.

12. The process of claim 8, wherein, when said flame is present, a rectified current flows between said second electrode and said third electrode.

13. The process of claim 12, further comprising shutting down said first potential when said rectified current is detected.

14. The process of claim 13, further comprising introducing a flow of said fuel adjacent said spark gap and shutting down said flow of said fuel if said rectified current is not detected in a predetermined time after said introduction of said flow.

15. The process of claim 12, further comprising, determining whether an alternating current flows between said second electrode and said third electrode, said rectified current flows between said second electrode and said third electrode, or no current flow between said second electrode and said third electrode.

16. The process of claim 15, further comprising, determining that the current is not verification of the presence of said flame, when an alternating current is determined to flow between said second electrode and said third electrode.

17. The process of claim 15, further comprising:

detecting whether an alternating current flows between said second electrode and said third electrode prior to fuel being introduce adjacent to said spark gap; and aborting said step (a) if said alternating current is detected.

18. The process of claim 8, wherein said first electrode and said second electrode form a spark rod with said first electrode being a center electrode of said spark rod and said second electrode being an electrode tube surrounding said center electrode such that a spark tip is formed having said spark gap.

19. The process of claim 18, wherein said third electrode is a fuel channel having a grounded wall and said spark rod is located therein, and wherein a fuel and air mixture is introduced into said channel such that said spark can ignite said fuel and air mixture.

* * * * *